United States Patent [19]

Oetiker

[11] 4,425,781

[45] Jan. 17, 1984

[54] METHOD FOR MANUFACTURING HOSE CLAMPS

[76] Inventor: Hans Oetiker, Oberdorfstrasse 21, CH-8810 Horgen, Switzerland

[21] Appl. No.: 231,275

[22] Filed: Feb. 4, 1981

[51] Int. Cl.[3] ..... B21D 53/36

[52] U.S. Cl. ..... 72/379; 72/218; 72/384; 24/20 R

[58] Field of Search ..... 24/20 R, 20 CW, 276, 24/279; 72/215–219, 379, 383, 384, 387, 388; 29/150, 417

[56] References Cited

U.S. PATENT DOCUMENTS 3,020,631 2/1962 Kennedy ..... 29/150

*Primary Examiner*—Lowell A. Larson

*Attorney, Agent, or Firm*—Craig & Burns

[57] ABSTRACT

A method and apparatus for manufacturing, handling and installing hose clamps pursuant to which the clamp structures are stamped out as flat blanks, are shipped as flat blanks to the user where they are preformed into an ideal shape for assembly about the object to be fastened by bending the free ends of the clamp in mutually opposite directions.

15 Claims, 11 Drawing Figures

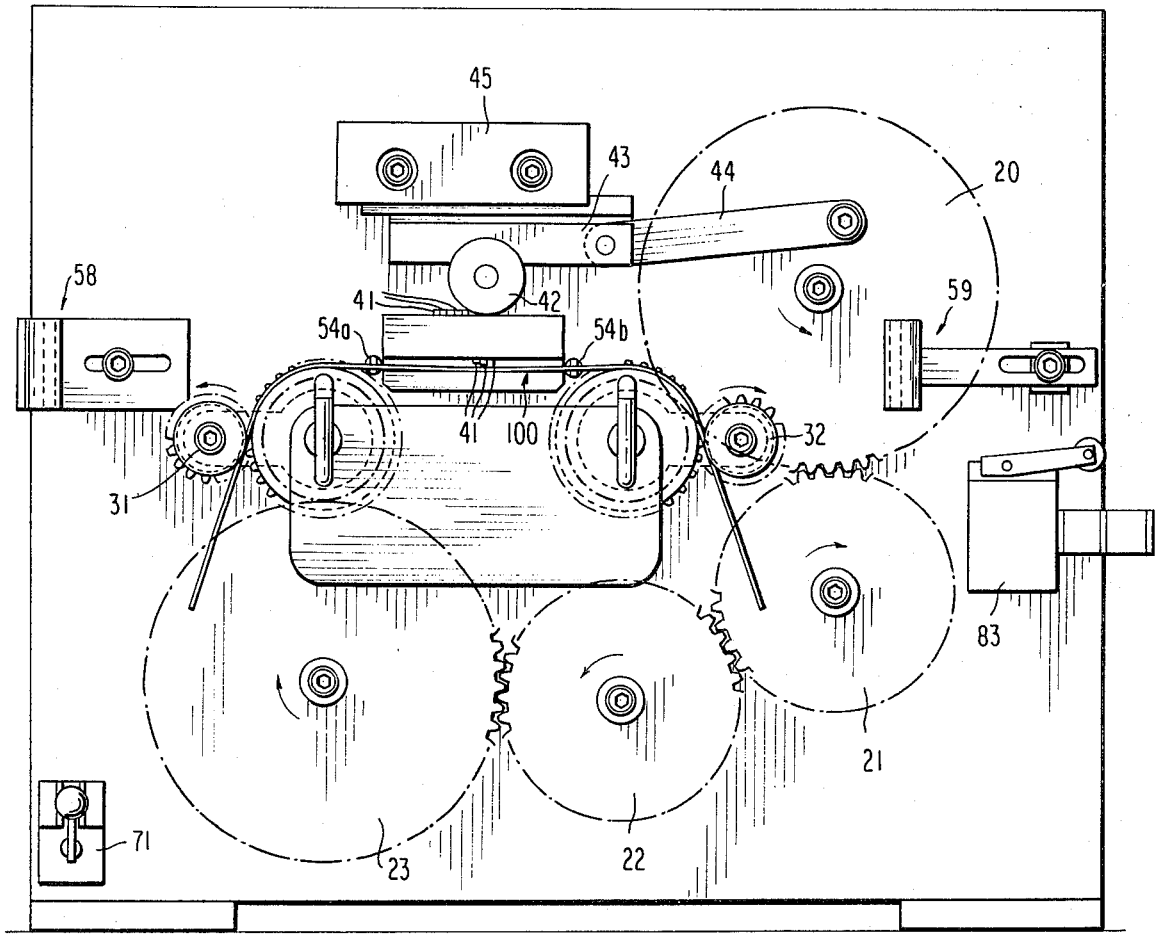
FIG. 4
FIG. 3
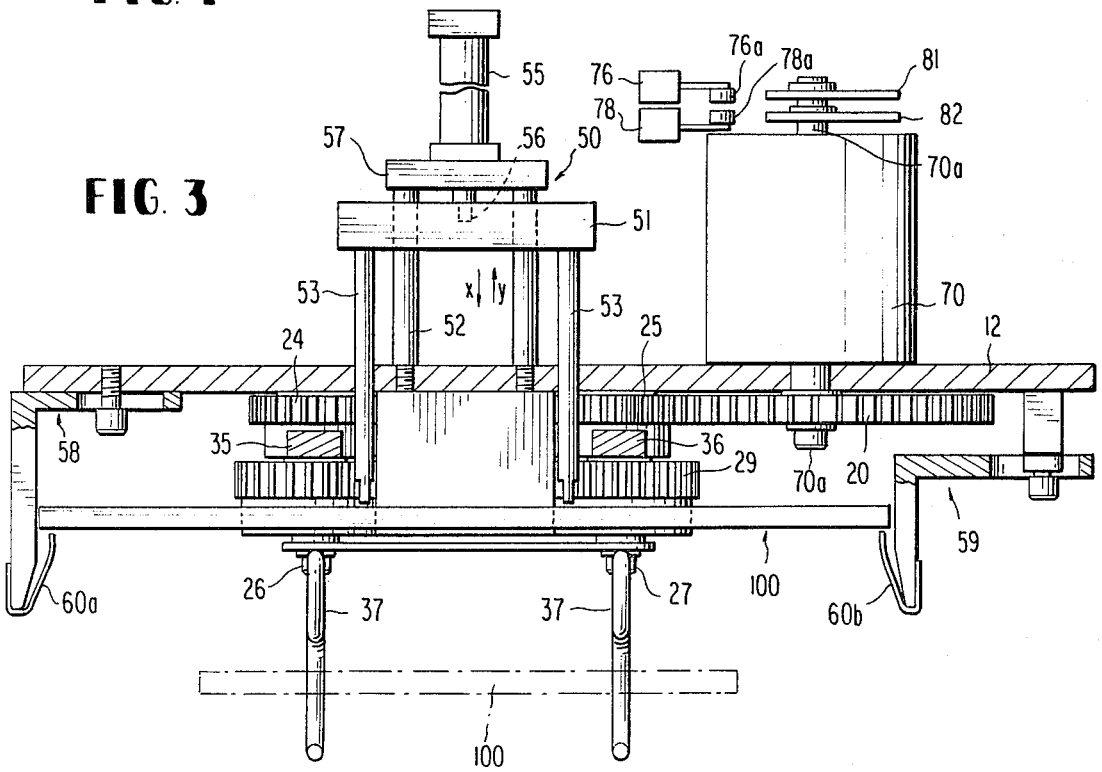

METHOD FOR MANUFACTURING HOSE CLAMPS

The present invention relates to a method and apparatus for the manufacture, handling and use of open clamp structures adapted to be assembled into endless clamps.

Though "Oetiker" (trademark) clamps of the endless type, as exemplified by U.S. Pat. Nos. 2,614,304 and 3,082,498 (FIGS. 1 and 2) which are made from tubular material or have their ends permanently connected, e.g., by spot-welding or in a rivet-like manner (U.S. Pat. No. 3,286,314), have been used extensively worldwide, they entail certain limitations and drawbacks. More particularly, the raw materials and/or manufacturing costs are relatively high and/or the rate of production is limited by the operating steps required. Moveover, the recent availability and ever-increasing use of plastic hose materials having a high degree of hardness of the order of 90° Shore or more and/or having a relatively small material thickness, require so-called stepless clamps devoid of any discontinuities, steps, or shoulders along the internal clamping surfaces thereof to assure complete tightness, as disclosed in my copending application Ser. No. 036,979, filed May 8, 1979 and entitled "Mechanical Lock for Clamps." These stepless clamps are open clamp structures which, broadly speaking, include a tongue-like portion near one end adapted to extend underneath the gap of a so-called "Oetiker" ear into a recess formed in the band by a step near the other end, and hooks adapted to engage in corresponding apertures provided at appropriate locations in the band.

Prior to these so-called stepless clamp structures, various types of open clamp structures also adapted to be interconnected by the engagement of hooks in apertures near the respective ends before tightening of the clamp structure, for example, by the contraction of a so-called "Oetiker" ear, were already known as such in the prior art, as disclosed, for example, in U.S. Pat. No. 3,082,498 (FIGS. 3 and 4), U.S. Pat. Nos. 3,475,793, 3,321,811, and 4,222,155.

All of these types of clamp structures can be installed either radially about the object to be fastened by engaging the hooks into corresponding apertures after the clamping band has been placed about the object to be fastened or can be installed axially after the clamp is already preassembled into an endless clamp structure where such installation is feasible. Though these clamps are made from flat band material, they have been usually manufactured in already generally circular shape at the place of manufacture to facilitate installation at the place of use, whence they are usually shipped to the customer in closed, endless condition, i.e., with the hooks already engaged in the apertures. Thus, it was an accepted, unquestioned practice heretofore that all types of open clamp structures were normally manufactured with generally circular configuration to assure proper installation thereof by the ultimate user since the installation difficulties encountered with open clamp structures of non-circular shape, for example, of flat configuration or flat configuration over only a major part of the clamping band were fully recognized. Attempts to obviate these difficulties, as disclosed, for example, in U.S. Pat. No. 3,235,925 to Gerhardt also proved of little success, not to mention other disadvantages inherent with this type of construction. Hence, these types of open clamp structures were normally manufactured and shipped heretofore to the customer generally in closed, endless condition, i.e., with the hooks of the circular band already engaged in the apertures, who then completed the installation about the object to be fastened and even reopened the same where necessary for radial installation. This meant in practice also that for each size of clamp, a different machine was required by the manufacturer, apart from the fact that the maximum rate of production was limited by that operating step requiring the greatest amount of time which turned out to be the bending of the clamps into more or less circular shape. With the large-quantity use of these types of open clamps in mass-production applications, such as on the assembly line of the automotive industry, the overall costs in the use of these clamps, dependent on cost of manufacture, handling and installation, are an important factor. Moreover, due to the fixed cost of the raw materials, a reduction in overall costs could be achieved for such clamp structures only by a reduction in the cost of manufacture, handling and use of these types of clamps.

Accordingly, a principal object of the present invention resides in a method and apparatus for manufacturing and using clamps of this type which permit a rationalization resulting in ultimate cost reduction to the user.

To fully appreciate the importance of the present invention, it is also necessary to consider those cost factors that accrue as a result of shipping and handling of the clamp structures between the place of manufacture and the place of actual use of the clamps when installed, for example, at the automotive assembly line.

As mentioned above, these types of clamps were normally shipped in closed condition, i.e., with the hooks engaged in the apertures. The preformed and pre-assembled clamps, if radially installed, were then reopened at the place of use, placed about the object to be fastened, and again closed before contraction of the so-called "Oetiker" ear which posed no problems since the clamps had been preformed at the place of manufacture into the more or less circular shape. However, I have found surprisingly that it takes about seven times as much space to ship these types of clamps in the closed condition as is required if shipped in flat condition. This means that the number of trucks required to transport these clamps is seven times as large when they are shipped in the closed condition than would be required if shipped in flat condition, which is significant in view of the cost of energy for the transport. Added thereto is the seven-fold cost of handling, i.e., packing the manufactured clamps into containers, loading the containers onto vehicles, unloading the containers from the vehicles at the place of use as well as handling of these containers in the plant where the clamps are installed. With the cost of labor and in particular with the ever-increasing cost of energy, savings by a factor of 1/7 in handling and transporting of these clamp structures become significant indeed. These considerations are particularly applicable to the larger clamp sizes, i.e., to clamp sizes of about 50 mm. in diameter or more, and are valid also if these clamp structures are merely preformed into generally circular shape at the place of manufacture without preassembly by interengagement of the hooks in the apertures.

On the other hand, if the clamps are shipped to the user in flat condition, the installation thereof becomes greatly more difficult, if not virtually impossible, since the stainless steel or galvanized band material having a certain inherent elasticity cannot be easily deformed uniformly by hand into the required circular shape.

Consequently, the present invention is also concerned with the task to provide a method and apparatus which permits a more rational manufacture, handling and use of the clamps accompanied by significant cost reductions.

The underlying problems are solved according to the present invention in that the clamps are stamped out at the place of manufacture from flat band material normally supplied in large rolls as substantially flat blanks, are then shipped to the customer in flat condition and are preformed into an ideal curved shape at the customer to facilitate installation thereof.

It is frequently necessary or desirable at the customer to stamp these clamps so as to indicate the date of installation, the shift which installed the same, and/or the identity or location of the installer. According to a further feature of the present invention, the method and apparatus in accordance with the present invention also permits the stamping of the clamp structures while being deformed.

Since the cost of containers is not insignificant, thus making it desirable to employ reusable containers, the present invention further proposes containers which can be stacked in empty condition for minimum space requirements during the return shipment thereof. This can be achieved, for example, by metal containers of part conical or frustoconical configuration, permitting a space-saving stacking.

The machine according to the present invention to preforming the flat blank comprises a retaining mechanism providing a rectilinear gap for holding fast the flat blank within its center area while its free ends are bent in mutually opposite directions to impart thereto an idealized configuration. In a preferred embodiment of the present invention, the means for preforming the free ends of the clamp include one cylindrical member on each side of the retaining mechanism which form abutment surfaces and are located to one side of the flat blank, and cylindrical roller members of smaller diameter forming counter-abutment surfaces which are so located to the other side of the blank as to define a gap between corresponding abutment and counter-abutment surfaces in rectilinear alignment with the gap in the retaining mechanism for receiving the flat blank, whereby the smaller cylindrical members are then rotated about the larger cylindrical members in the direction toward a respective free end of the blank, thereby taking along the free ends of the blank and preforming the same by bending. The free ends are thereby bent to a greater extent than required for the ideal shape since the springiness of the band material from which these clamps are made will cause the same to spring back to some extent from the condition of maximum bending to assume the idealized condition.

According to still another feature of the present invention, the preforming machine is far-reachingly automated in such a manner that after insertion of the flat blank into the retaining mechanism, it is only necessary to initiate manually the movement of the smaller cylindrical members about the larger cylindrical members until the former reach their limit position after they have passed beyond the free ends of the clamp. In that limit position or preferably just prior thereto, an ejecting mechanism is actuated which causes the thus-preformed open clamp structure to be ejected while reversal of the direction of rotation of the smaller cylindrical members is caused by actuation in the limit position of a limit switch to return the smaller cylindrical members again to their start position where their movement is stopped and the machine readied for the next preforming operation. The control for the preforming machine may be by pneumatic, hydraulic, electrical or any other conventional means known in the prior art.

According to a still further feature of the present invention, the blanks are stamped or engraved in the center area where they are retained in the retaining mechanism in that plunger-like stamping members are retained in one of the members of the retaining mechanism in such a manner that a reciprocating roller passes over the exposed rear surfaces of these stamping members during its reciprocating motion in one direction while the free ends of the blank are deformed, thereby pressing the stamping members into the surface of the center area of the blank; the roller member is then caused to reciprocate in the opposite direction after the blank is ejected. Since the position of the stamping members is so arranged that they are pressed only a small distance into the surface of the band of the clamp which is disposed in the gap of the retaining mechanism, no damage can occur during the return movement of the roller after the blank has been ejected.

According to another feature of the present invention, the machine is so constructed that it permits efficient use of the machine operator in that after insertion of a blank and initiation of the automatic operation of the machine, the operator can then pick up the previously preformed, still open clamp structure and while the preforming operation goes on, pre-assemble the same over the object to be fastened to engage the hooks in the apertures. In the meantime, the last blank which had been inserted into the machine has been preformed and ejected so that after insertion of the next blank, the operator can proceed to preassemble the thus-preformed clamp structure which had been ejected in the meantime in a corresponding manner. Of course, it is also possible for the operator not only to preassemble the preformed open clamp structure over the object to be fastened, but also to complete the assembly by contracting the "Oetiker" ear before the next blank is inserted into the preforming machine. It is thus clear that the final tightening of the clamp structure by contraction of the ear can take place at any suitable location along the assembly line, for instance, at a place remote from the location of the preassembly.

These and further objects, features and advantages of the present invention will become more apparent from the following description when taken in connection with the accompanying drawing which shows, for purposes of illustration only, one embodiment in accordance with the present invention, and wherein:

FIG. 3 is a cross-sectional view taken along line III—III of FIG. 1;

FIG. 4 is a schematic elevational view, similar to FIG. 1, of the preforming machine in accordance with the present invention and showing the position of the parts thereof, in which the free ends of the blank of the clamp structure have been deformed through almost 90°;

Figure 1:
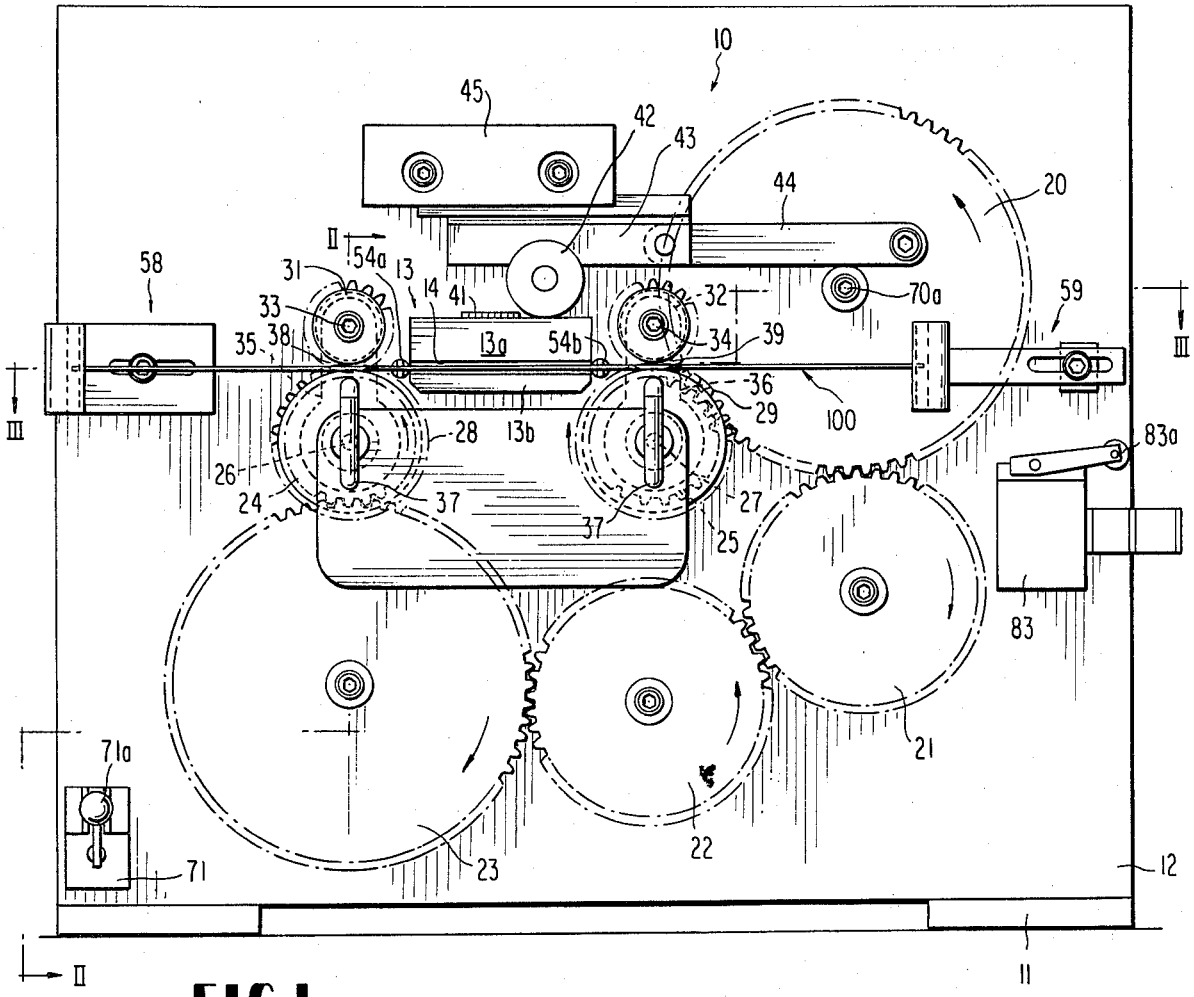
FIG. 1 is a somewhat schematic elevational view of a preforming machine in accordance with the present invention, showing the parts thereof in the starting position with a relatively flat blank of the open clamp structure inserted into the machine.
Figure 2:
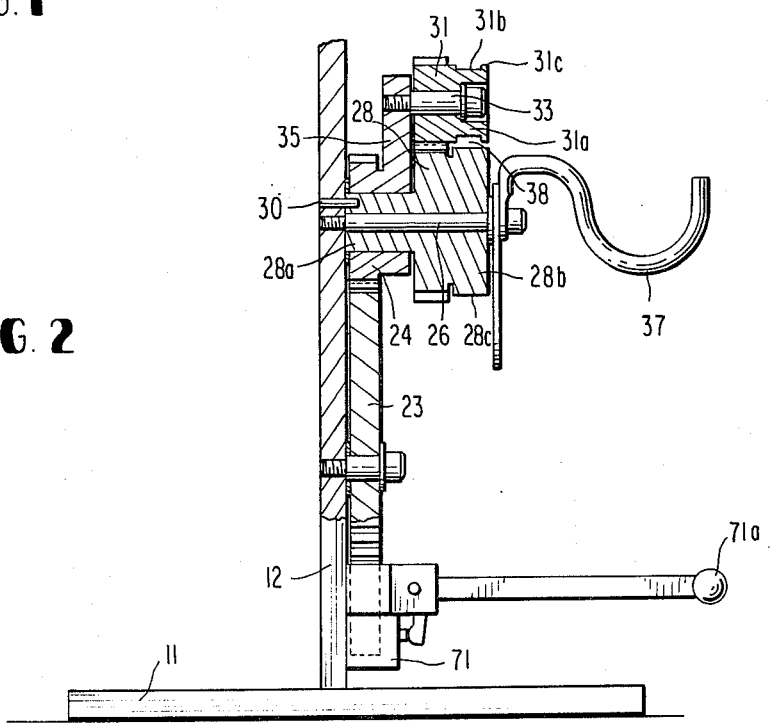
FIG. 2 is a cross-sectional view taken along line II—II of FIG. 1.

Referring now to the drawing wherein like reference numerals are used throughout the various views to designate like parts, and more particularly to FIGS. 1, 2 and 3, reference numeral 10 generally designates therein a preforming and dating machine in accordance with the present invention which is supported on a suitable frame consisting, for example, of a base 11 and of an upright support member 12. The retaining mechanism generally designated by reference numeral 13 for receiving the center area of the blank 100 and for retaining the same substantially flat includes an upper member 13*a* and a lower member 13*b* defining therebetween a substantially rectilinear gap 14 whose length determines the non-deformed center area of the clamp in its final shape.

The preforming machine in accordance with the present invention includes a large driving gear 20 suitably connected with a driving motor 70 (FIG. 3) of any conventional type. In the illustrated embodiment, the driving motor 70 is a reversible pneumatic motor. However, an electric motor or a hydraulic motor or any other suitable known driving means can be used in the present invention. The driving gear 20 is in meshing engagement with a smaller gear 21 which in turn is in meshing engagement with a gear 22 of identical size as gear 21, gears 21 and 22 constituting reversing gears. The gear 22 is again in meshing engagement with gear 23 which is of identical size as driving gear 20. Gears 20 and 23, in turn, are in meshing engagement with smaller gears 24 and 25 (FIGS. 1, 2 and 3) rotatably supported in any known manner. As shown for gear 24 in FIG. 2, gear 24 is thereby rotatably supported on cylindrical neck portion 28*a* of a somewhat larger gear 28 which is mounted on shaft 26 and is prevented from rotation by conventional means, for example, pin 30. Gear 25 is similarly rotatably supported on a neck portion (not shown) of gear 29 which is fixedly supported on shaft 27 (FIG. 3). Thus, gears 28 and 29 are held stationary in the manner of fixed sun gears. Smaller gears 31 and 32 are rotatably supported on shafts 33 and 34 which shafts 33 and 34 in turn are connected with gears 24 and 25 to rotate in unison therewith by connections 35 and 36 in such a manner that parts 33, 35 and 34, 36 form planet carriers for planet gears 31 and 32 in meshing engagement with gears 28 and 29, whereby the planet carriers are rotated by rotation of gears 24 and 25, respectively. Hook-like support members 37 shaped to hold the ejected, preformed clamp structure, are also mounted on shafts 26 and 27. In addition to the neck portion 28*a*, gear 28 is provided with a cylindrical extension 28*b* whose external cylindrical surfaces 28*c* form abutment surfaces about which the flat blank 100 is bent. For that purpose, gear 31 is also provided with a cylindrical extension 31*a* whose external cylindrical surfaces 31*b* form counter-abutment surfaces in such a manner that abutment and counter-abutment surfaces 28*c* and 31*b* define therebetween a gap 38 which is closed off in the ejection direction by a small ledge portion 31*c* (FIG. 2) to assist in retaining the blank in place during the preforming operation. Counter-abutment surface 31*b* can be simply formed by machining an annular groove with flat bottom into the cylindrical extension 31*a*. With the parts in the position illustrated in FIG. 1, gap 38 is in substantially rectilinear alignment with the gap 14. A similar gap 39 is formed between the cylindrical extensions of gears 29 and 33 which are constructed in a manner corresponding to gears 28 and 31. Annular counter-abutment surfaces are thus intentionally recessed as shown in FIG. 2 since the ledge portion 31*c* then contributes to retaining the blank 100 in proper position during the preforming operation by preventing it from moving in the ejection direction, thereby obviating the need for any clamping action by retaining mechanism 13.

If gear 20 rotates in the counterclockwise direction as shown by the arrow, then gear 23 will rotate in the clockwise direction so that gear 24 will rotate in the counterclockwise direction and gear 25 in the clockwise direction. This in turn will cause the planet carrier 35 and therewith gear 31 to rotate about gear 28 in the counterclockwise direction in the manner of a planet gear rotating about a fixed sun gear. Similarly, gear 32 will rotate about gear 29 in the clockwise direction. Rotation of gear 20 will additionally cause crank 44 and therewith the roller assembly 42, 43 to carry out longitudinal reciprocating motions between the upper surface of member 13*a* and the guide structure 45. Since gears 20 and 23, gears 21 and 22, gears 24 and 25, gears 28 and 29 and gears 31 and 32 are pairs of gears of identical size, gears 31 and 32 will rotate at identical speeds in opposite directions when driving gear 20 is rotated by motor 70.

The date-stamping mechanism which, of course, may also be used to impart additional or alternative information such as identification of installation location, assembly, installation personnel, etc., includes a number of stamps 41, for example, spring-loaded, plunger-like stamping members received within the upper clamping member 13*a* in such a manner that their normally exposed rear surfaces are adapted to be depressed, thereby causing their lower surfaces to engrave into an underlying blank 100 in gap 14, when the roller 42 moves over their rear faces toward the left as viewed in FIG. 1. For that purpose, the roller 42 is itself rotatably supported on roller support 43 which is constrained to longitudinal movements between the upper surface of member 13*a* and guide structure 45 when reciprocated by actuation from gear 20 by way of crank 44.

In order to further facilitate insertion and retention of the blank 100 in the starting position shown in FIG. 1, the machine is provided with blank retention devices generally designated by reference numerals 58 and 59 (FIG. 1) which are adjustable in the longitudinal direction of the blank and include springy fingers 60*a* and 60*b* whose inclined surfaces are so arranged (FIG. 3) that in the position shown in FIG. 1, the blank, during its insertion into gaps 14, 38 and 39, will displace these fingers by riding up on their inclined surfaces whereupon these fingers will spring back into their position shown in FIG. 3 to prevent the blank 100 from inadvertently falling out before the bending operation is started which brings into action the retention function of the ledge portion 31*a* of gear 31 and of a similar ledge portion in gear 32.

The ejection mechanism generally designated by reference numeral 50 (FIG. 3) consists of a support member 57 secured onto upright frame member 12 by bolts 52. The support member 57 carries a cylindrical piston unit 55 whose piston rod 56 is secured to the member 51 slidably mounted on the bolts 52 and carrying ejection fingers 53 which are adapted to move through openings 54*a* and 54*b* (FIG. 1) provided in the upright member 12. Movement of the piston rod 56 and therewith of support member 51 and of ejection fingers 53 in the direction X will cause the blank to be ejected out of the gap 14 onto the hooks 37 while movement in the Y direction will cause the parts to assume the normal, retracted position shown in FIG. 3. The control of the reciprocating movement of the parts 55, 56, 51 and 53 will be described more fully hereinafter.

Figure 11:
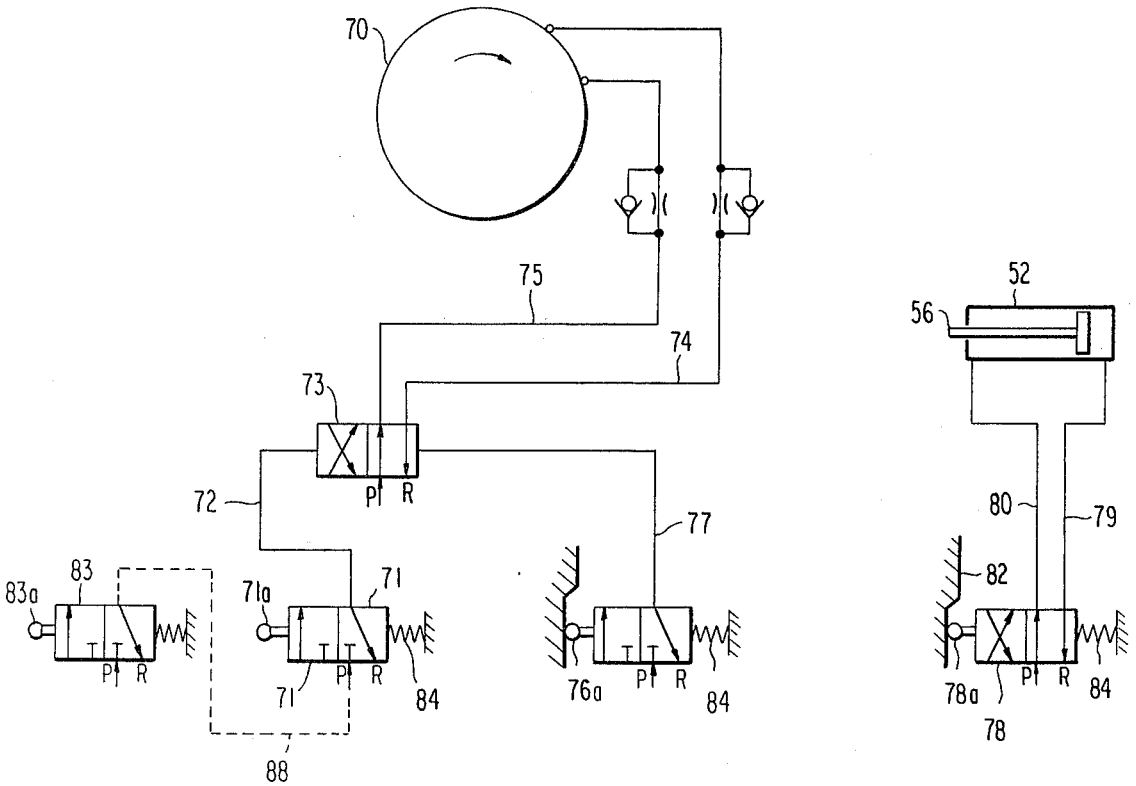
FIG. 11 is a schematic diagram of the pneumatic control circuit for a preforming machine in accordance with the present invention.

Turning now to the schematic diagram of FIG. 11, the pneumatic drive motor 70 is adapted to be supplied selectively with compressed air so as to rotate in the forward or reverse direction. In the schematic diagram of FIG. 11, the connection indicated by P is the connection with the supply for the pressure medium such as compressed air while the connection indicated by R is the exhaust connection. A manually actuatable valve 71, normally in the position shown in FIG. 11, will, after actuation of its valve actuator 71*a*, selectively connect the pressure source P by way of line 72 with a reversing valve 73 which is of such commercially available type that it stays in its last-actuated position and is adapted to selectively valve the supply of pressure medium to the driving motor 70 by way of line 74 for forward rotation and by way of line 75 for reverse rotation. Lines 74 and 75 may thereby include conventional pressure-reducing devices and excess pressure valves to protect the motor 70. A limit valve 76 which is normally in the position indicated in FIG. 11 is adapted to supply pressure medium to the reversing valve 73 when actuated by cam 81, mounted on motor shaft 70*a* of driving motor 70. The piston cylinder unit 55 of the ejection mechanism 50 is adapted to be selectively supplied with pressure medium by way of lines 79 and 80, selectively valved by ejection valve 78 which itself is actuated by cam 82 on motor shaft 70*a*. Valves 71, 76 and 78, which are of any commercially available type, are normally retained in the pistons illustrated in FIG. 11 by springs of conventional type accommodated within the valve housings thereof which are schematically indicated in FIG. 11 where they are designated by reference numeral 84.

OPERATION

Figure 5:
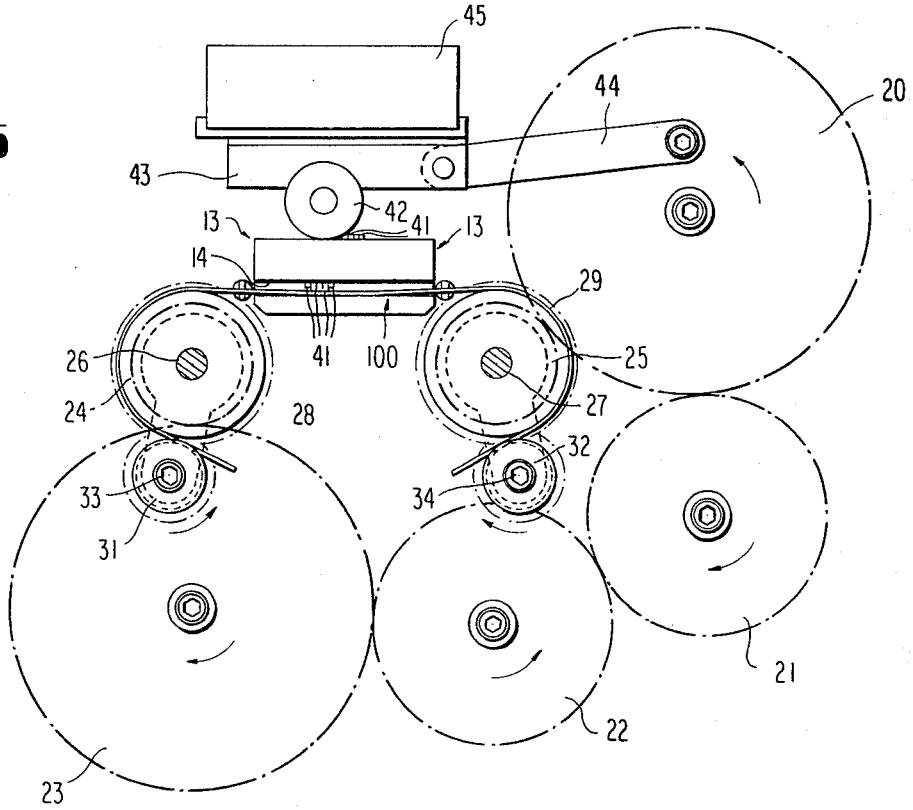
FIG. 5 is a schematic elevational view, similar to FIGS. 1 and 4, and showing the position of the parts shortly prior to maximum bending of the free ends of the clamp structure.
Figure 6:
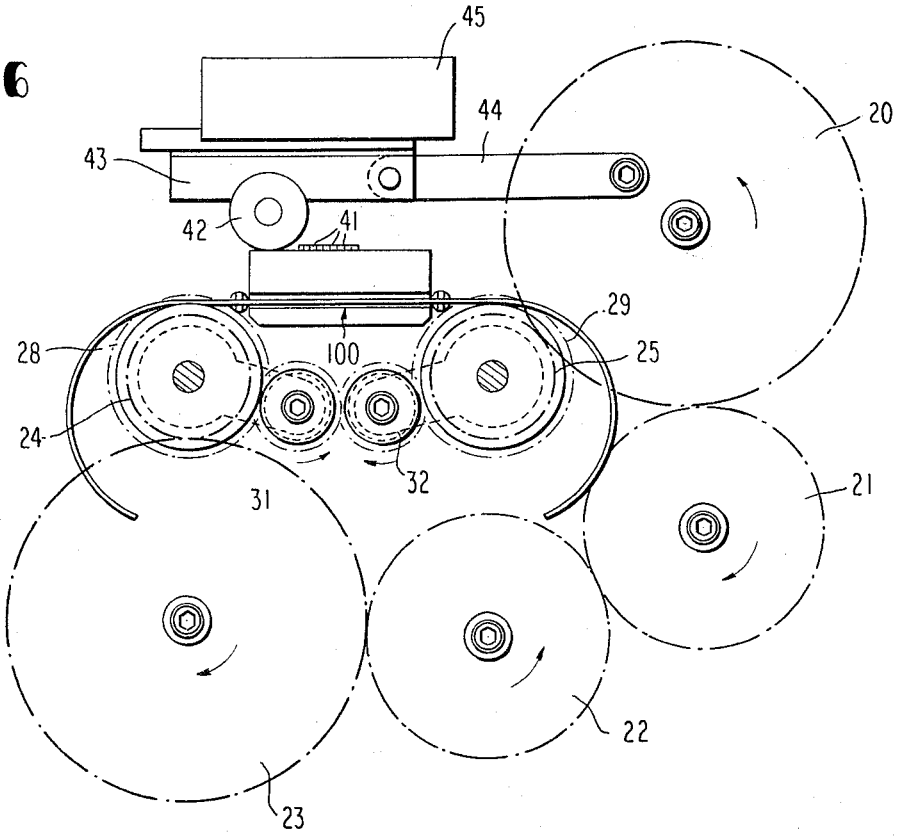
FIG. 6 is a schematic elevational view, similar to FIGS. 1, 4, and 5, of the preforming machine of the present invention and showing the position of the parts thereof after the smaller cylindrical deforming members have passed beyond the free ends of the blank and have reached their limit position.
Figure 9:
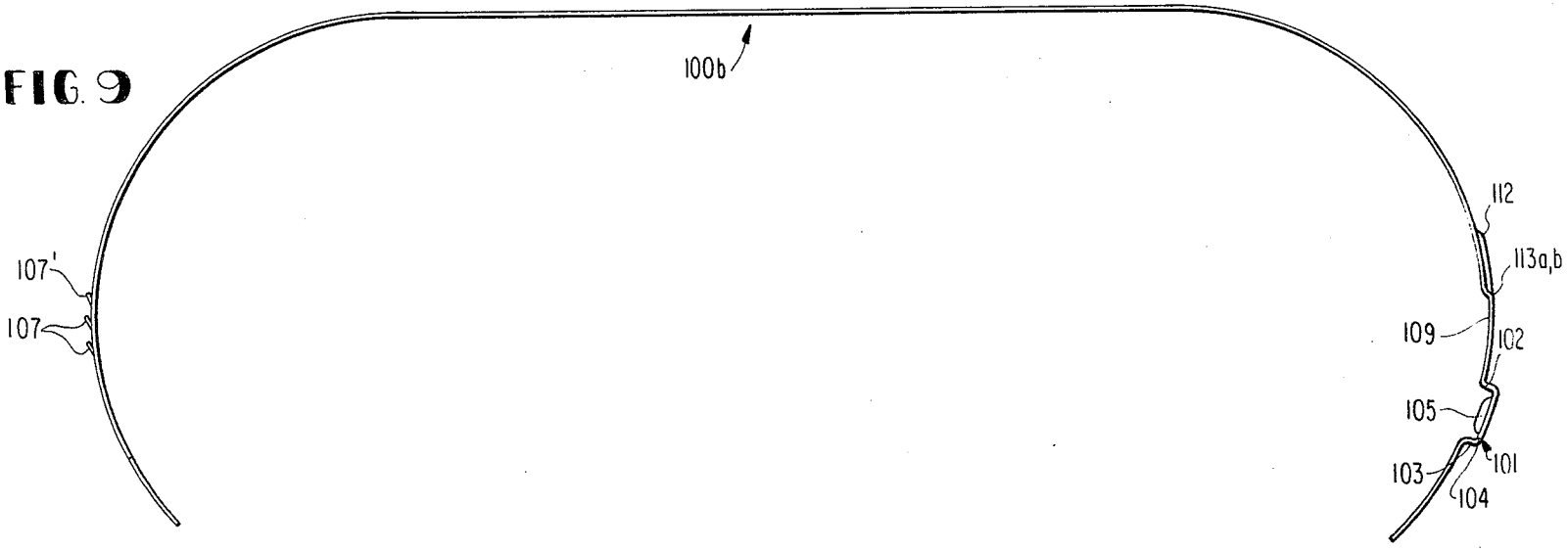
FIG. 9 is an elevational view of the clamp structure shown in FIG. 8 showing the preformed clamp structure in its final shape after it elastically springs back into an ideal shape permitting a convenient and correct manual closing thereof in generally circular form.
Figure 8:
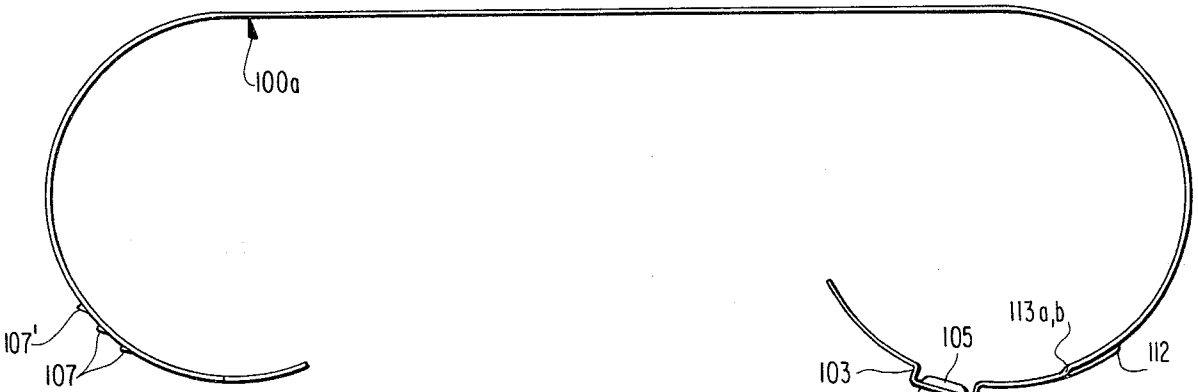
FIG. 8 is an elevational view of the clamp structure of the blank of FIG. 7 in its maximum deformed condition.
Figure 10:
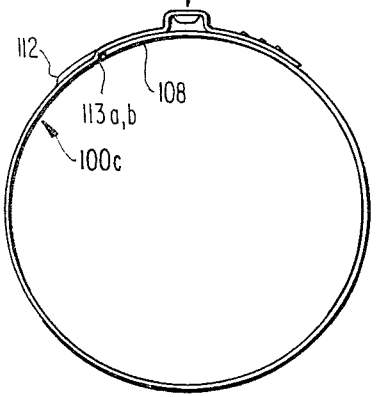
FIG. 10 is an elevational view of the clamp structure of FIG. 9 in the closed condition thereof with the hooks engaged in apertures with the ear non-contracted.

The parts are in their start position shown in FIGS. 1 and 11 in which a blank 100 has been inserted into the gap 14 and gaps 38 and 39 where it is retained also by fingers 60*a* and 60*b*. The actuating member 71*a* of starting valve 71 is now momentarily depressed which will apply pressure medium by way of line 72 to reversing valve 73, causing the valve 73 to shift and therewith causing the driving motor 70 to be supplied with pressure medium by way of line 74 to thereby start its forward rotation and therewith rotation of gear 20 in the direction indicated by the arrow in FIG. 1. As a result thereof, the gears 21, 22, 23, 24 and 25 will rotate in the directions indicated by the arrows in FIG. 1, so that gears 31 and 32, in their planetary rotation about gears 28 and 29 will start to rotate about the axes of the latter in meshing engagement therewith, taking along the free ends of the blank 100 to bend the same as indicated in FIGS. 4 and 5 until such time as the gears 31 and 32 pass beyond the free ends of the now maximum bent blank 100*a* (FIG. 8) in their travel toward their limit position shown in FIG. 6. The groove-like configuration of surfaces 31*b* of gear 31 and corresponding surfaces of gear 32 will prevent the blank 100 from inadvertently snapping out of its position in gaps 14, 38 and 39. Just prior to reaching this limit position of gears 31 and 32, cam 82 mounted on motor shaft 70*a* will come in contact with actuating member 78*a* of ejection valve 78, thereby shifting valve 78 to connect the source of compressed medium P by way of line 79 with the piston and cylinder unit 55 which, in turn, will cause the piston rod 56, the member 51 and therewith the ejection fingers 53 to move in the X direction (FIG. 3) to thereby eject the preformed blank 100*b* (FIG. 9) onto the support hooks 37. A very short time later, cam 81 on motor shaft 71*a* will actuate the actuating member 76*a* of valve 76 which causes the valve 76 to be shifted to supply pressure medium by way of line 77 to the opposite side of the reversing valve 73, thereby causing the latter to be shifted back to the position shown in FIG. 11 and the pressure medium to be supplied to the driving motor 70 by way of line 75 for rotation in the reverse direction. Valves 76 and 78 will stay in the actuated, shifted condition until in due course of such reverse direction of rotation, cams 81 and 82 will again become disengaged from actuating members 76*a* and 78*a*, thereby causing valves 76 and 78 to return to their normal position as shown in FIG. 11. While the shifting-back of valve 76 will have no effect on the ongoing operation, the shifting-back of valve 78 will cause the cylinder piston unit to retract the ejection fingers to their normal position shown in FIG. 3. Motor 70 will now rotate back to its starting position as shown in FIG. 1 until gears 31 and 32 come to stop at fixed abutments, formed, for example, by parts of the retaining mechanism 13 to await the start of the next cycle of operation which is commenced by depressing again the valve-actuating member 71*a* of valve 71. FIGS. 1, 4, 5 and 6 also illustrate the movements of the crank 44, support 43 and roller 42 of the marking mechanism. As can be seen from FIG. 1, all stamping members 41 are in their normal position in which none of the stamping members are in engagement with the blank. FIGS. 4 and 5 illustrate how roller 42 causes the stamping members 41 to mark or stamp the surface of the blank 100 while FIG. 6 shows roller 42 again out of engagement with any stamping members 41 in the limit position of gears 31 and 32. As gears 31 and 32 rotate back from their limit position shown in FIG. 6 to their starting position shown in FIG. 1, the roller 42 again passes over the exposed rear surfaces of the stamping members 41. However, since no blank is present any longer in gap 14 and since the maximum amount the stamping members can be depressed is relatively small, for example, of the order of 1/10 mm., the return movement of the roller 42 will have no effect. For the sake of good understanding, the projecting positions of the stamping members 41 have not been shown to scale in the various figures, but rather in an exaggerated manner since their movement is too small for a recognizable showing in the drawing. As the parts reach their start position in FIG. 1, the machine is thus ready again for the next cycle of operation, which will be initiated by depressing the valve actuator 71*a* after a new blank is inserted.

If, for safety reasons, a two-hand operation of the machine is desired, it is only necessary to disconnect the pressure supply from valve 71 and to connect instead an additional starting valve 83 in series therewith by line 88 as indicated in dash lines in FIG. 11. This will now require simultaneous actuation of valve actuators 71*a* and 83*a* which are thereby so located on the support 12 that they cannot be actuated simultaneously with only one hand, but require both hands to do so.

If, in lieu of the pneumatic system shown in FIG. 11, an electrical system is used, it is only necessary to provide appropriate solenoids for the valves with holding circuits to keep the solenoids energized until such time as normally closed limit switches in the holding circuits which are actuated by cams 81 and 82 are intended to de-energize the respective solenoid. Moreover, the control system may also be partly pneumatic and partly electrical, for example, using a pneumatic motor with the valves controlling the flow of the pneumatic pressure medium controlled by solenoids or equivalent electronic circuits, e.g., transistorized integrated circuits.

Figure 7:
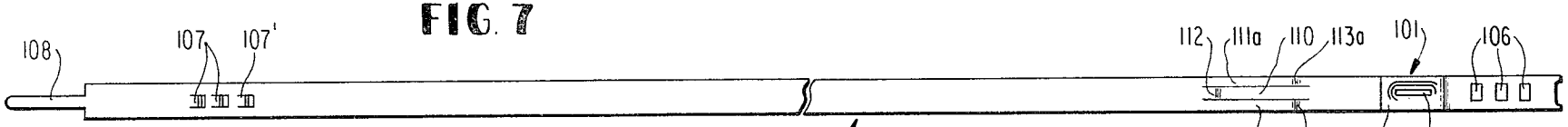
FIG. 7 is a plan view on a flat blank of a clamp structure in accordance with the present invention which can be preformed in the machine of FIGS. 1–6.

While the present invention is applicable to any type of hose clamp, it is of particular significance to so-called stepless clamps which are manufactured as open clamp structures and are used in ever-increasing large numbers in the manufacture of mass-produced items. These stepless clamp structures, in addition to a typical "Oetiker" ear generally designated by reference numeral 101 (FIGS. 7, 8, 9 and 10) that consists of outwardly extending legs 102 and 103 connected by bridging member 104 provided with a reinforcing groove 105, include teeth or hooks 107 adapted to engage in apertures 106. That end of the clamp structure which is provided with the teeth 107 also includes a tongue portion 108 which extends underneath the gap of the ear 101 into a recess 109 to assure a stepless inner configuration of the clamp structure, when installed, devoid of discontinuities, shoulders or offsets once the clamp is tightened by contraction of the ear 101. The recess 109 can be formed, for example, by a pressed-out center portion 110 of the clamping band which has been cut a short distance in the circumferential direction so as to leave side portions 111*a* and 111*b* on both sides thereof whereby a step is formed within the area 112 of the center portion 110 while steps 113*a* and 113*b* are formed within the indicated areas of the side portions 111*a* and 111*b* as shown in FIG. 7. Moreover, to assure proper holding ability of the clamp under high forces, hooks or teeth 107 may be support hooks while hook or tooth 107′ may be a guide hook as more fully disclosed in my copending application Ser. No. 036,980, filed May 8, 1979, and entitled "Hose Clamp."

In order not to damage the ear 101 and the recess 109 during the preforming operation by the normal dimension of gap 38 or 39, recesses of complementary shape may be provided, for example, in surface 31*b* of cylindrical extension 31*a* of gear 31 or similar surfaces of gear 32. These recesses—not shown for the sake of clarity of the drawing—can be conveniently machined into the corresponding surfaces at the proper location since these locations are fixed for a given size of clamp and can thus be easily determined.

The preforming machine in accordance with the present invention is simple in construction, and, compared to machines available to date which perform only a dating function of the clamp, relatively inexpensive even though the machine of the present invention performs the additional function of preforming the flat blank into a configuration well suited for subsequent manual preassembly into the clsed clamp. Moreover, the machine in accordance with the present invention is easy to handle and requires no special skills so that a relatively unskilled person can operate the same without difficulty. Moreover, the preforming machine, by reason of its small size and low weight, can be readily moved and installed where necessary. If used, for example, on the assembly line, the operator may both perform the preforming operation and the radial preassembly of the open clamp structure by engaging the hooks into the apertures after the band of the clamp is placed about the object to be fastened. This preassembly is greatly facilitated by the preforming of the clamp structure. Secure tightening of the clamp or of several clamps may then be carried out by another person appropriately located along the assembly line with the use of suitable pneumatic pincers or also by the person performing the preforming and preassembly operations. Moreover, since the machines used for stamping-out the blank of the clamp structure are no longer required to bend the clamp structure into circular shape, the same machines can be used for manufacturing clamps of different size—and possibly also of different types—by merely exchanging one set of stamping dies for another. Thus, it can be readily seen that the present invention permits a far-reaching rationalization in the manufacture, handling and use of such types of open clamp structures with attendant significant savings in costs.

The terms "flat blank" are used herein to describe the fact that the band material as such is not curved, but remains in substantially rectilinear condition though, of course, it already includes teeth as well as the ear, and in case of a stepless clamp, the recess, which are all formed in the band material during the stamping-out operation of the flat blank as shown in FIG. 7.

While I have shown and described only one embodiment in accordance with the present invention, it is understood that the same is not limited thereto but is susceptible of numerous changes and modifications as known to those skilled in the art. For example, instead of a pneumatic motor 70, an electric motor or hydraulic motor may be used. Hence, I do not wish to be limited to the details shown and described herein but intend to cover all such changes and modifications as are encompassed by the scope of the appended claims.

I claim:

1. A method for manufacturing open hose clamps of the type made from substantially flat springy band material whose open ends are adapted to be mechanically connected with each other by hook means near one band end adapted to engage in aperture means near the other end of the band to permit radial assembly of the clamp about an object to be fastened, comprising the steps of stamping out from band material a substantially flat blank representing the open clamp provided with the hook and aperture means, and preforming the thus-stamped out substantially flat blank by bending each of its free ends into a predetermined generally part-circular configuration to permit the thus preformed blank to spring back to an open shape which facilitates assembly over the object to be fastened by subsequent engagement of the hook means into the aperture means.

2. A method according to claim 1, wherein an ear means adapted to be contracted and having generally outwardly extending leg portions interconnected by a circumferentially extending bridging portion is formed in a flat blank during the stamping-out operation.

3. A method according to claim 1 or 2, in which the steps of stamping-out the substantially flat blank and of preforming the stamped-out blank are separate operations.

4. A method according to claim 1 or 2, further comprising the step of physically transporting the clamps as substantially flat blanks from a first place where the stamping-out step is carried out to a second place where the step of preforming is carried out.

5. A method according to claim 4, wherein the flat blanks are transported in generally side-by-side relationship within containers that can be stacked during the empty return transport thereof.

6. A method according to claim 4, wherein the containers are of such configuration as to enable stacking thereof in empty condition for the return transport from the second to the first place.

7. A method according to claim 3, further comprising the step of applying an identifying mark to the flat blank during the preforming step.

8. A method according to claim 7, wherein the identifying mark includes at least one of date and identity of user of the clamp.

9. A method according to claim 1 or 2, wherein only the ends of the flat blank are deformed while the center area of the blank remains essentially flat.

10. A method for manufacturing open hose clamps of the type made from substantially flat band material having a certain inherent springiness, whose open ends are adapted to be mechanically connected with each other by hook means near one band end adapted to engage in aperture means near the other end of the band to permit radial assembly of the clamp about an object to be fastened, comprising the steps of stamping out from band material a substantially flat blank representing the open clamp provided with the hook and aperture means, and preforming the thus stamped-out substantially flat blank by bending each of its ends into a generally part-circular configuration to facilitate assembly over the object to be fastened by engagement of the hook means into the aperture means including the substeps of inserting the center area of a flat blank into a gap of a retaining mechanism of the preforming machine, bending the free ends of the blank in mutually opposite directions about curved surfaces until the free ends abut substantially against said curved surfaces, and thereafter releasing the thus-bent free ends to permit the same to spring back to an idealized shape in which the free ends have radii of curvature larger than those corresponding to the maximum bent position thereof as a result of the inherent springiness of the band material.

11. A method according to claim 10, in which the free ends of the blank are bent about generally circular abutment surfaces while its center remains substantially flat.

12. A method according to claim 11, further comprising the step of physically transporting the clamps as substantially flat blanks from a first place where the stamping-out step is carried out to a second place where the step of preforming is carried out.

13. A method according to claim 10, in which only the ends of the flat blank are deformed while the center area of the blank remains essentially flat.

14. A method according to claim 13, further comprising the step of physically transporting the clamps as substantially flat blanks from a first place where the stamping-out step is carried out to a second place where the step of preforming is carried out.

15. A method according to claim 10, wherein an ear means adapted to be contracted and having generally outwardly extending leg portions interconnected by a circumferentially extending bridging portion is formed in a flat blank during the stamping-out operation.

* * * * *